US006752044B2

(12) United States Patent
Hawkins, III

(10) Patent No.: US 6,752,044 B2
(45) Date of Patent: Jun. 22, 2004

(54) POWER TONG ASSEMBLY AND METHOD

(75) Inventor: Samuel P. Hawkins, III, Lafayette, LA (US)

(73) Assignee: Frank's International, Inc., Houston, TX (US)

( * ) Notice: Subject to any disclaimer, the term of this patent is extended or adjusted under 35 U.S.C. 154(b) by 0 days.

(21) Appl. No.: 10/139,525

(22) Filed: May 6, 2002

(65) Prior Publication Data

US 2003/0205112 A1 Nov. 6, 2003

(51) Int. Cl.[7] ..... B25B 13/50

(52) U.S. Cl. ..... 81/57.34; 81/57.35; 81/57.36; 81/57.16

(58) Field of Search ..... 81/57.16, 57.34, 81/57.35, 57.24, 57.44, 57.36, 57.19, 57.21

(56) References Cited

U.S. PATENT DOCUMENTS 5,868,045 A * 2/1999 Hauk ..... 81/57.34
6,142,041 A * 11/2000 Buck ..... 81/57.35
6,318,214 B1 * 11/2001 Buck ..... 81/57.35
2002/0078798 A1 * 6/2002 Castille ..... 81/57.34
2002/0157823 A1 * 10/2002 Pietras et al. ..... 81/57.16
2002/0178871 A1 * 12/2002 Hauk et al. ..... 81/57.16

* cited by examiner

*Primary Examiner*—James G. Smith
(74) *Attorney, Agent, or Firm*—The Matthews Firm

(57) ABSTRACT

A power tong system and method is disclosed for making and breaking joints between wellbore. The system comprises a frame to which a spinner is mounted for spinning the wellbore tubulars. A first member is pivotally mounted with respect to the frame such that the first member is rotatable with respect to the frame. A piston/cylinder assembly is pivotally mounted with respect to the frame and with respect to the first member whereby the first member is rotatable with respect to the frame in response to movement of the piston with respect to the cylinder. A control arm is preferably pivotally mounted to the first member and the piston/cylinder assembly. The control arm is securable, such as with a moveable pin or a latch, to the first member in at least two positions for controlling whether the first member is operable for making or for breaking the joints.

20 Claims, 5 Drawing Sheets

POWER TONG ASSEMBLY AND METHOD

TECHNICAL FIELD

The present invention relates generally to making up and breaking out wellbore tubulars and, more particularly, to apparatus and methods for a simplified self-contained power tong for use in a rig floor environment.

BACKGROUND ART

Power tong systems maybe used to spin, makeup, or connect and breakout or disconnect wellbore tubulars that may have a wide range of diameters. Comparison studies between use of traditional separate tongs and spinners as compared with a self-contained power tong system makeup and breakout tool working under similar conditions have shown cost savings that range from one-quarter of a million to more than a million dollars per well, depending on the well conditions.

Separate, manually operated tongs, spinners, and/or chains are significantly slower and less accurate and consistent in making up and breaking out wellbore tubulars than a single tool or unit that does all such functions. Besides increased speeds of making up and breaking out tubular connections, other time saving advantages of a self-contained power tong unit also include factors such as eliminating the need to redress tongs when changing from drill pipe to drill collars and the integration of spinning with makeup and breakout functions. Due to the high daily cost of drilling rigs, comparison studies show that the time/cost savings can be substantial.

The self-contained power tong system also operates more reliably than separate tongs and spinners and may provide a central torque regulator that connects to and controls all components to assure consistent makeup. This feature prevents thread damage caused by over-tightening and automatically prevents errors that could result in under-torqued connections. Obviously, a single error, when making up hundreds of threaded connections in a drill string, can result in huge costs of time and material, and even loss of a well.

The self-contained power tong system also eliminates accident conditions commonly associated with separately moveable independent tongs which apply high torque and which are located by personnel on the floor. As well, independent tongs have attendant separate cables used to pull on each separate tong, and may also use snatch blocks. Thus, the personnel must work between high tension cables that pull on the tongs and accidents can easily occur under such conditions, e.g., if a tong loses its grip and moves rapidly across the rig floor accelerated by the high tension on the cable. Of course, accidents can slow work progress and significantly increase the costs of drilling.

Safety is also improved because the invention provides a single tool to perform all such functions, rather than separate elements, permits the use of central safety features such as, for instance, a lockout to prevent spinner operation if the tongs are not engaged, a safe location for the operator to stand and work, a design whereby the operator's hands and feet are safely away from moving parts, elimination of spinning chains, and a lockout to prevent operation of the lift cylinder when any tong is engaged.

Because of the great utility of prior art self-contained power tong units to makeup and breakout pipes, and the increasingly expanding market for such devices, it has been found highly desirable to make further improvements. It would be highly desirable to simplify the operation of such devices thereby reducing the number of components necessary for operation of the power tong unit. Consequently, there remains a need for an improved self-contained makeup and breakout unit that reduces the complexity and therefore the costs such as manufacturing costs and maintenance thereof. Those skilled in the art have long sought and will appreciate the present invention which addresses these and other problems.

SUMMARY OF THE INVENTION

The present invention was designed to provide more efficient operation to thereby reduce drilling costs, to improve reliability of making and breaking pipe joints, to permit increased automation to reduce required manpower, to improve safety, and to free other rig equipment for other uses.

Therefore, it is an object of the present invention to provide an improved self-contained power tong unit for making and breaking well bore tubulars.

Another object of the present invention is to provide a self-contained power tong with fewer and more reliable components.

An advantage of the present invention is increased reliability of operation.

Another advantage of the present invention is reduced costs.

Yet another advantage is improved reliability, accuracy, and consistency in making up joints.

These and other objectives, features, and advantages of the present invention will become apparent from the drawings, the descriptions given herein, and the appended claims. However, it will be understood that above-listed objectives and/or advantages of the invention are intended only as an aid in quickly understanding aspects of the invention, are not intended to limit the invention in anyway, and therefore do not form a comprehensive or restrictive list of objectives, and/or features, and/or advantages.

Accordingly, the invention comprises, in one embodiment thereof, a power tong system operable for making and breaking joints between wellbore tubulars. The power tong system may comprise one or more elements such as, for instance, a frame, a spinner secured to the frame that is operable for spinning the wellbore tubulars for the making and breaking of the joints, and/or a first member pivotally connected with respect to the frame such that the first member is rotatable with respect to the frame. The first member preferably defines a bore and/or a slot therein for receiving the wellbore tubulars. Other elements may, for instance, comprise a first plurality of gripping members mounted to the first member which are movable inwardly and outwardly for gripping and releasing the wellbore tubulars, and/or a piston/cylinder assembly comprising a piston slidable within a cylinder. The piston/cylinder assembly may be pivotally mounted with respect to the frame and with respect to the first member such that the first member is rotatable with respect to the frame in response to movement of the piston with respect to the cylinder. Additional elements may comprise a second member mounted to the frame also defining a slot therein for receiving the wellbore tubulars and a second plurality of gripping members mounted to the second member. The second plurality of gripping members may also be movable inwardly and outwardly for gripping and releasing the wellbore tubulars.

The power tong system may further comprise a control arm mounted to the first member, the control arm may be moveable between a first position and a second position, the first member may be rotatable for tightening the wellbore joints in the first position, the first member may be rotatable for loosening the wellbore joints in the second position. Other elements may comprise a fastener for selectively securing the control arm in the first position or the second position. In one embodiment, the fastener further comprises a pin, latch, or other fastening means.

The power tong system may further comprise a pivotal connection between the control arm and the first member and/or a pivotal connection between the control arm and the piston/cylinder assembly.

The plurality of gripping members may comprise a guide member whereby the guide member maybe moveable to a selectable position for a size of the wellbore tubulars. The guide member may then be affixed in the selectable position, and remain affixed, during gripping and releasing of the wellbore tubulars. The guide member cooperates with one or more gripping members that are radially moveable inwardly and outwardly for gripping and releasing the wellbore tubulars. The guide member maybe positioned along the bore through the first member for receiving the wellbore tubulars on an opposite side from the slot.

A method for a power tong system for making and breaking joints between wellbore tubulars are provided that may comprise one or more steps such as, for instance, mounting a plurality of gripping members to a rotatable member, providing that the gripping members are moveable inwardly toward the tubulars for gripping the wellbore tubulars and moveable outwardly away from the tubulars for releasing the wellbore tubulars, pivotally mounting a control to the rotatable member, connecting a piston/cylinder assembly which may comprise a piston and a cylinder, to the control arm such that the rotatable member rotates in response to movement of the piston with respect to the cylinder, providing that the control arm is moveable between a first position and a second position, providing that when the control arm is in the first position, then the member is operable for applying torque to the wellbore tubulars for making the joints, and/or providing that when the control arm is in the second position, then the member is operable for applying torque to the wellbore tubulars for breaking the joints.

The method may further comprise providing a frame, and pivotally mounting the rotatable member to the frame. The method may further comprise mounting a tubing inspection tool to the frame. The method may further comprise utilizing the tubing inspection tool for locating the joints with respect to the rotatable member.

The method may further comprise providing a second member, and providing that the second member is axially moveable with respect to the rotatable member and/or providing an extendable member operable for raising and lowering the rotatable member.

The method may further comprise providing an optical collar locator for locating the joints with respect to the first member and/or using optical circuits in the optical collar locator for inspecting the wellbore tubulars for nonconformities.

In yet another embodiment, the power tong system may comprise, a frame, a first member pivotally connected with respect to the frame such that the first member is rotatable with respect to the frame, a first gripping assembly mounted to the first member for gripping and releasing the wellbore tubulars, a second member mounted to the frame, a second gripping assembly mounted to the second member for gripping and releasing the wellbore tubulars, lift members attached to the frame for moving the first member and the second member upwardly and downwardly to align the first member and the second member with respect to the joints, a joint connection detector operable for detecting joint connector components for producing a joint signal to indicate the joint connection components wherein the joint connection detector may be in a clearance position with respect to the joint connection components, and an automatic control for receiving the joint connector. The automatic control may be operable for operating the lift members to automatically align the first gripping assembly and the second gripping assembly with respect to the joints.

The joint connection detector may further comprise a pipe inspection apparatus. For instance, an electrical coil, or other electrical device for receiving or sending electromagnetic signals, or for detecting magnetic flux changes, which may preferably be utilized by both the collar detector and the pipe inspection apparatus.

The joint connection detector may also comprise an optical recognition system. Moreover, the optical recognition system may be utilized for pipe inspection, assuming the pipe is clean and dry. Additional features such as automatically removable lens caps, covers, and so forth could also be utilized as desired to keep the lens clean. Moreover, infrared light or other wavelengths may be utilized to improve night vision and reduce effects of moisture or the like.

The system may further comprise automatic slips and a sender for the automatic slips that is used to send status information which may be received by the control. A plurality of sensors may be provided which are operable for measuring pressure, movement, and the like, and may be used, for instance, for determining torque versus turn during the making up of the joints. Other elements may comprise a piston/cylinder assembly which includes a piston slidable within a cylinder wherein the piston/cylinder assembly may be pivotally mounted with respect to the frame and/or a control arm mounted to first member. The piston/cylinder assembly may be pivotally connected to the control arm such that the first member is rotatable with respect to the frame in response to movement of the piston with respect to the cylinder.

This summary is not intended to be a limitation with respect to the features of the invention as claimed, and this and other objects can be more readily observed and understood in the detailed description of the preferred embodiment and in the claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

While the present invention will be described in connection with presently preferred embodiments, it will be understood that it is not intended to limit the invention to those embodiments. On the contrary, it is intended to cover all alternatives, modifications, and equivalents included within the spirit of the invention.

GENERAL DESCRIPTION OF PREFERRED MODES FOR CARRYING OUT THE INVENTION

Figure 1:
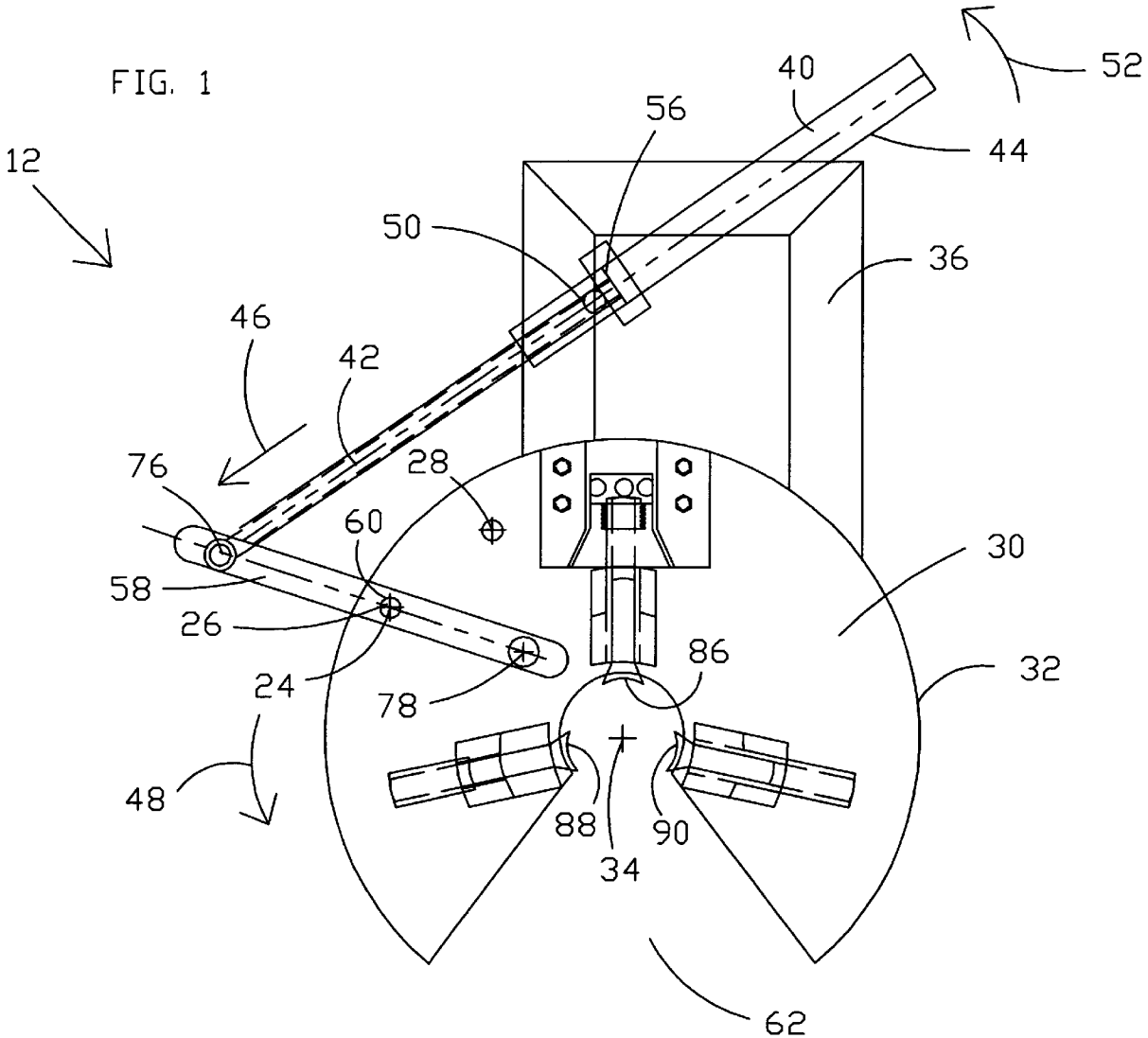
FIG. 1 is an elevational view, partially in phantom lines, showing a tong in a first position and selectively rotatable in a first direction in accord with one embodiment of the invention.
Figure 5:
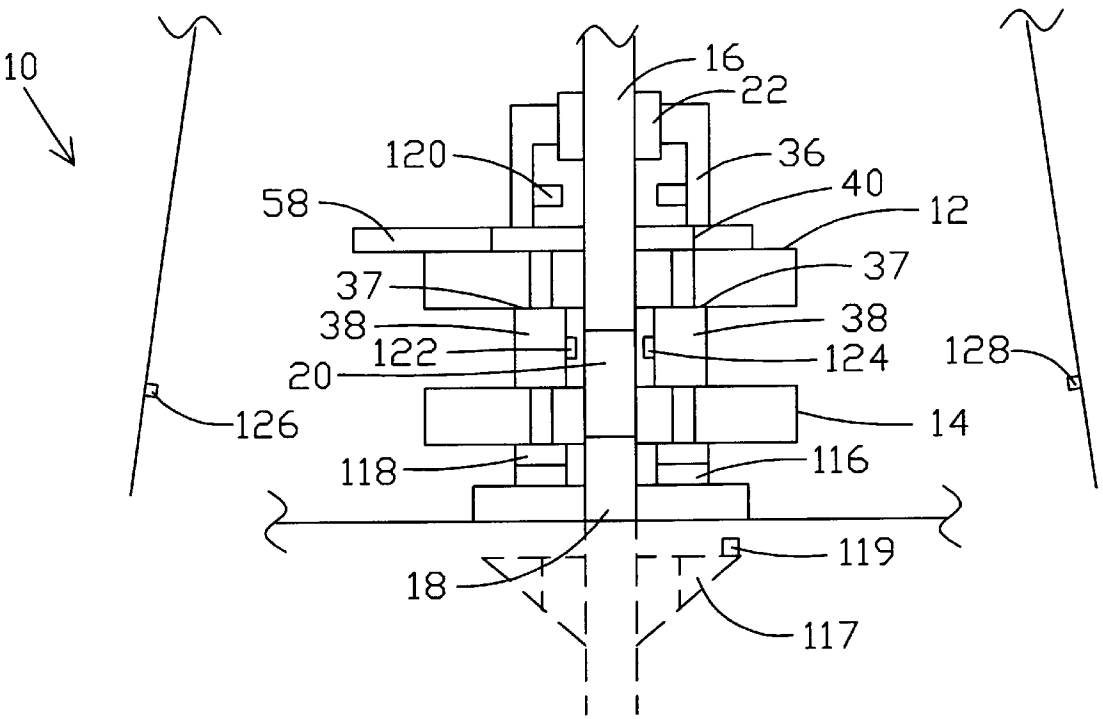
FIG. 5 is an elevational view of a self-contained power tong in accord with one embodiment of the invention.

Referring now to the drawings and more particularly to FIG. 1, there is shown a preferred embodiment of rotatable tong 12 for applying torque to tubular connections. In FIG. 5 there is shown one possible embodiment of self-contained power tong system 10 in accord with the present invention utilizing one or more rotatable tongs 12 for applying torque to tubular connections.

Rotatable tong 12 may be utilized as an upper tong or a lower tong and may also be used for both an upper tong and a lower tong which operate in conjunction with each other by rotating in opposite directions. In the embodiment shown in FIG. 5, upper rotatable tong 12 operates in conjunction with a lower fixed position lower tong 14. Thus, upper tong 12 rotates and applies torque to upper pipe 16 while lower tong 14 acts as a back-up tong for holding lower pipe 18 in a fixed position. While in a preferred embodiment, lower tong 14 does not rotate, lower tong 14 could also be designed to rotate in an opposite direction with respect to upper tong 12, thereby doubling the degree of potential rotation available per operation for application of torque to joint 20. Upper tong 12 and lower tong 14 effectively provide sturdy upper and lower members which also support gripping members, as discussed below, in a suitable manner for applying high forces to the joint connections.

In a preferred embodiment, spinner 22 is utilized to quickly spin or rotate upper pipe 16 with respect to lower pipe 18 which is held in position by lower tong 14 until the joint is almost made up. Spinners are well known in the prior art and spinner 22 may utilize a known spinner design, if desired. While spinner 22 is capable of spinning pipe quickly until the threaded connection is almost made up thereby reducing the time required per joint, spinner 22 typically does not have sufficient power to apply the necessary torque required to complete the make-up for most tubular joints. Therefore, it is desirable to utilize spinner 22 in conjunction with a tong set capable of applying the necessary torque, as might be required per pipe manufacturer's recommendations.

Figure 2:
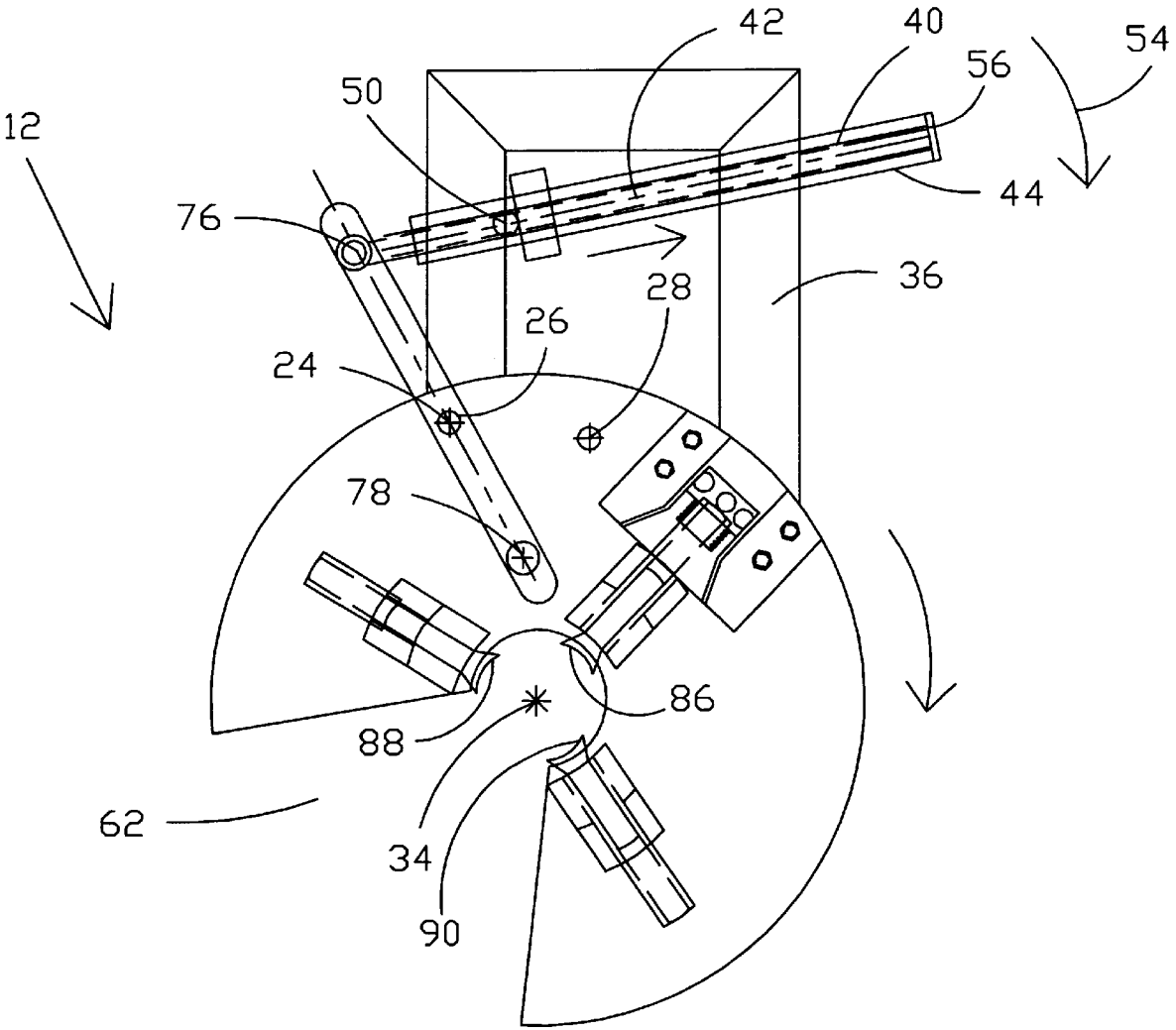
FIG. 2 is an elevational view, partially in phantom lines, showing the tong of FIG. 1 in a second position after rotation in the first direction in accord with one embodiment of the invention.

While upper tong 12 rotates only a relatively few degrees, as suggested in the different positions of upper tong 12 between FIG. 1 and FIG. 2, the upper tong 12 rotates with ample high-torque to complete the joint make-up according to the drill pipe manufacturers' specifications or any other standards.

FIG. 1, FIG. 2, FIG. 3, and FIG. 4 show, in some detail, the salient characteristics an embodiment of rotatable tong 12 of the present invention during various stages of operation, including rotation effectively in two different directions to thereby permit the same tong set to be utilized for both making-up and breaking-out pipe joint connections. Depending on the location of pin 24 in hole 26 or in hole 28, rotatable tong 12 may be made to effectively rotate in opposite directions for selectively tightening (making-up) or loosening (breaking-out) tubular joints, as discussed in more detail hereinafter.

In FIG. 1, rotatable tong 12 may comprise a circular member 30 with a circular outer perimeter 32. However, rotatable tong 12 may also be shaped differently around its perimeter. In any case, member 30 is built to have sufficient structural integrity to apply the necessary torque. Rotatable member 30 may comprise layers, support beams, housings to cover the elements shown in the drawings, and the like as desired, to provide the necessary structural integrity to apply the necessary torque.

Member 30 of rotatable tong 12 maybe mounted for rotation around rotation center point 34. Member 30 may be supported by suitable bearings as indicated at 37 in FIG. 5 between preferably telescoping and/or preferably moveable structural support members 38. Alternatively or in addition, suitable bearings may be provided for mounting to tong frame 36 (not shown). The bearings for mounting member 30, such as bearings 37 and/or other bearings, must be sufficiently strong to support the various forces acting thereof while torque is applied while constraining member 30 to rotate about center point 34.

In a preferred embodiment, rotatable tong 12 rotates in response to force produced by piston/cylinder assembly 40. Piston/cylinder assembly 40 actuates reciprocal movement of piston rod 42 with respect to cylinder housing 44. Piston/cylinder assembly 40 may be hydraulically or pneumatically actuated, as desired.

FIG. 1 shows rotatable tong 12 in the starting position prior to rotation with piston rod 42 extended with respect to cylinder housing 44. In the starting position slot or throat 62 is oriented to permit the pipe to move into or out of power tong system 10 prior to or subsequent to performing an operation involving applying torque to the pipe joint. FIG. 2 shows rotatable tong 12 in an ending position just after the joint has been operated upon with piston rod 42 retracted with respect to cylinder housing 44. The ending position may typically be in the range of thirty to one hundred degrees of rotation from the starting position. Movement arrows 46 and 48 in FIG. 1 show that rotational movement in the direction indicated by arrow 48 is associated with extension movement of piston rod 42 with respect to cylinder housing 44 as indicated by directional movement arrow 46. In this top view, extension of piston rod 42 results in counterclockwise rotational direction of member 30.

In order to follow or track or rotate with the movement of disc-shaped member 30, piston/cylinder assembly 40 is preferably pivotally mounted and maybe designed to pivot around pivot connection 50, or any other suitable pivot point, as desired. Pivot connection 50 may preferably pivotally interconnect frame 36 with piston/cylinder assembly 40. However, other frame members or support members could be utilized to mount pivot connection 50 for pivotally supporting piston/cylinder assembly 40. When piston rod 42 extends as per FIG. 1, then piston/cylinder assembly 40 also rotates counter-clockwise as indicated by directional arrow 52. When piston rod 42 contracts as per FIG. 2, then piston/cylinder assembly 40 rotates clockwise as indicated by directional arrow 54. Other expandable/retractable assemblies could be utilized in place of piston/cylinder 40. However, piston/cylinder assembly 40 is a presently preferred embodiment of the invention. Piston 56 is conveniently moved by fluid pressure (either hydraulic or pneumatic) applied to piston 56. Piston 56 may be mounted to piston rod 42 and piston cylinder 44 at any suitable axial position therealong to facilitate suitable control of piston rod 42 within piston cylinder 44 and facilitate suitably placed fluid connections.

Piston rod 42 is preferably pivotally connected to control arm 58 by pivot connection 76. Control arm 58 is also pivotally connected at pivot connection 78. Pivot connection 78 permits control arm 58 to move back and forth between the two positions depending on whether the joint is to be tightened or loosened. Holes 26 and 28 in member 30 are selected to provide the desired positioning of member 30 so that member 30 is oriented in the correct beginning position prior to operation and in the correct ending position just after torque has been applied. The length of control arm 58 maybe chosen to provide additional leverage of operation and degree of potential rotation. However, if desired, one or more piston/cylinder assemblies could be pivotally connected directly to member 30 and positioned to rotate member 30. As well, other link mechanisms besides control arm 58 could be utilized for interconnecting one or more piston/cylinder assemblies for rotating member 30.

Figure 3:
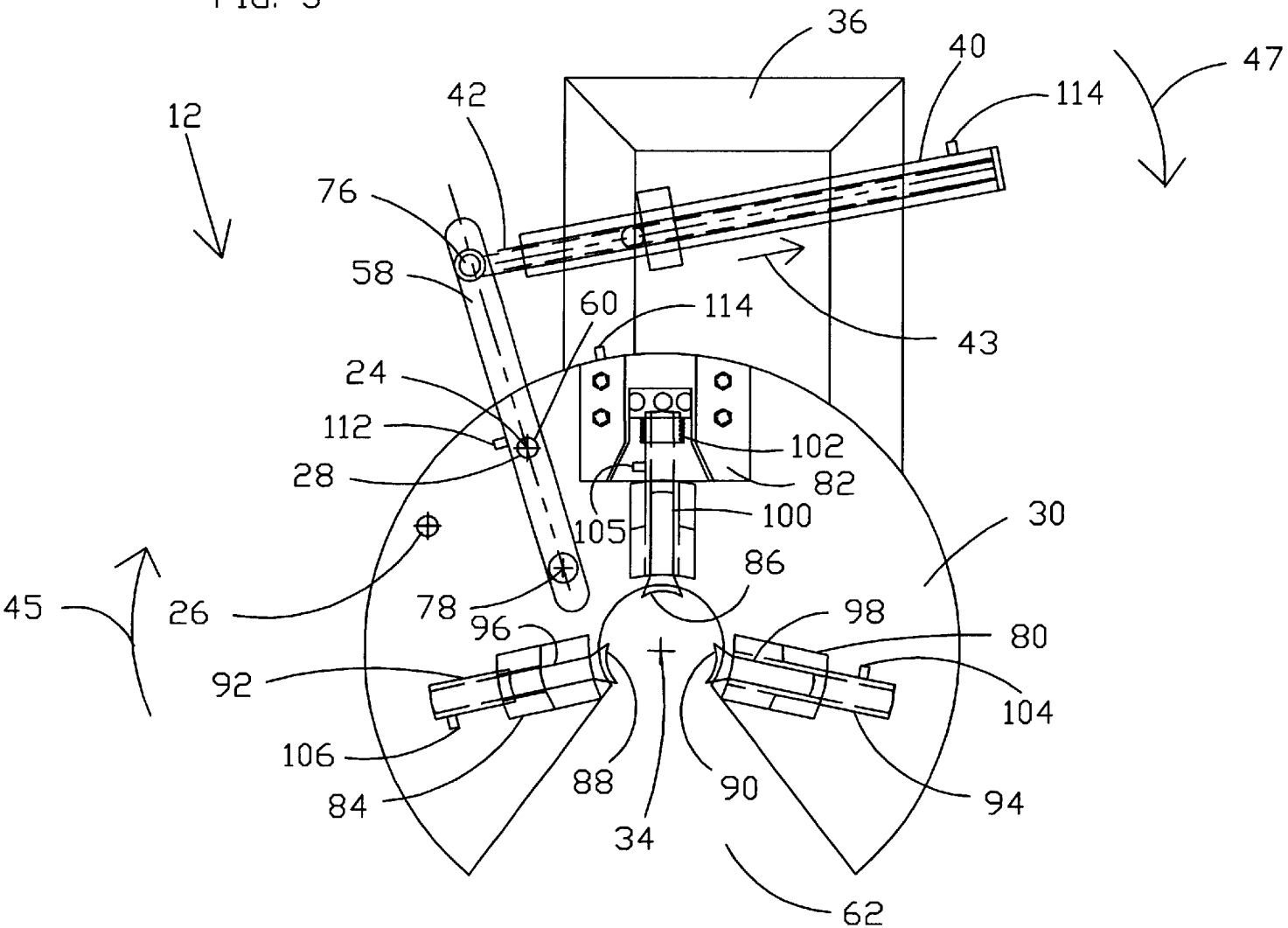
FIG. 3 is an elevational view, partially in phantom lines, showing the tong of FIG. 1 in a first position and selectively rotatable in a second direction in accord with one embodiment of the invention.
Figure 4:
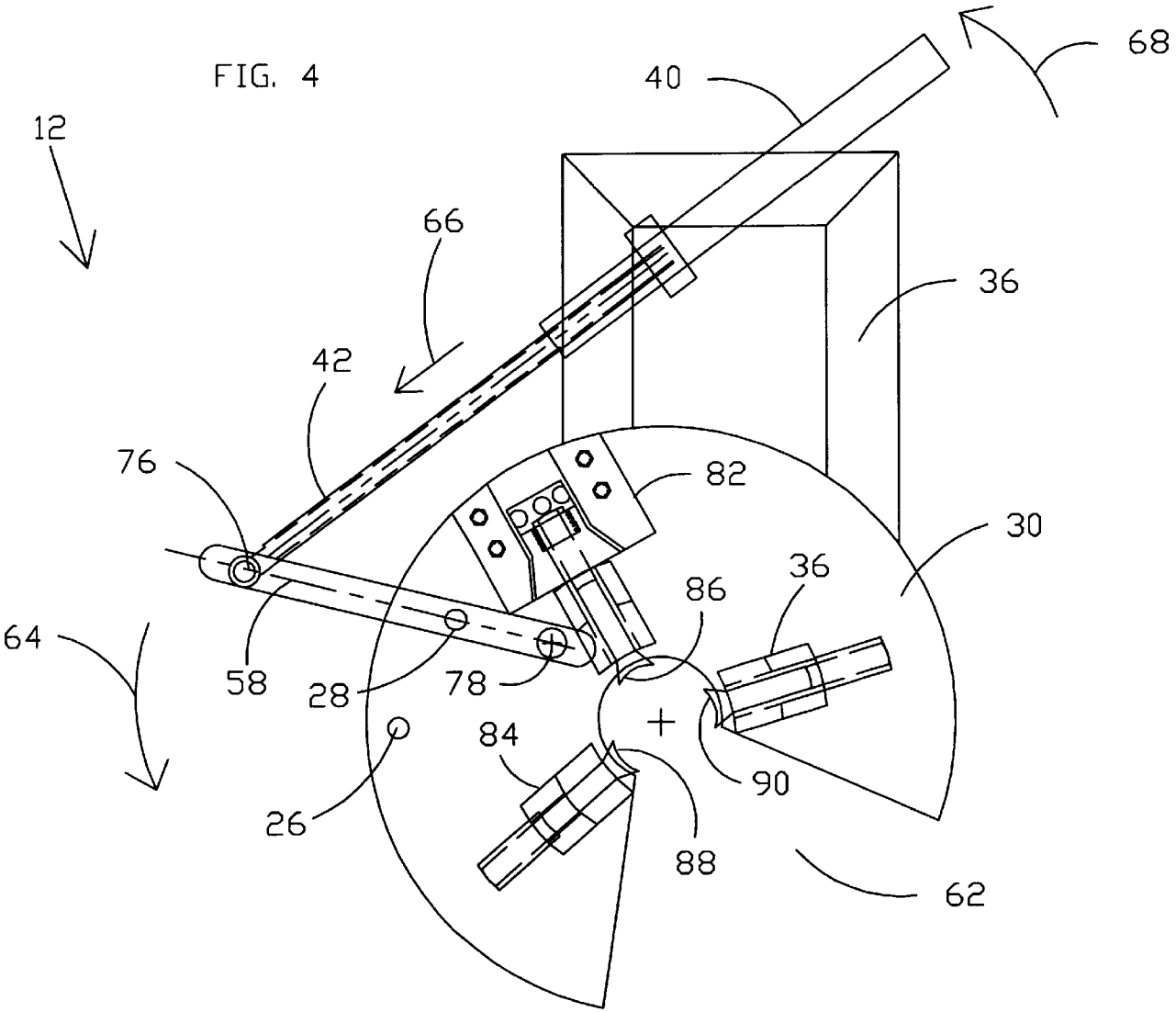
FIG. 4 is an elevational view, partially in phantom lines, showing the tong of FIG. 3 in a second position after rotation is the second direction in accord with one embodiment of the invention.

FIG. 3 and FIG. 4, as compared to FIG. 1 and FIG. 2, show the effect of removing pin 24 from hole 26 of member 30, pivoting control arm 58 until mating hole 60 in control arm 58 is aligned to hole 28, and inserting pin 24 therein. Pin 24 may be held in place by clips, latches, cotter pins, and so forth. With pin 24 mounted through hole 28 of member 30 and hole 60 of control arm 58, rotatable tong 12 may be made to effectively turn in the opposite direction from the starting position as shown in FIG. 1 and FIG. 2. In this case, as shown in FIG. 3, piston rod 42 is in a retracted position with respect to piston/cylinder assembly 40 when slot 62 is in the starting position. Piston rod 42 moves in the direction indicated by arrow 43, then member 30 rotates as indicated at 45, and piston/cylinder assembly rotates as indicated at 47.

Then as shown in FIG. 4, member 30 rotates counterclockwise from the starting position as indicated by arrow 64 as piston rod 42 extends in the direction of arrow 66 with respect to piston/cylinder assembly 40. Piston/cylinder housing rotates counterclockwise as indicated by arrow 68 and as discussed hereinbefore. To return to the opening position, piston rod 42 is contracted or moved as indicated by arrow 43 in FIG. 3 toward piston/cylinder housing 40. Corresponding to movement of piston rod 42 in the direction of arrow 43, member 30 of rotatable tong 12 rotates clockwise as indicated by arrow 45 and piston/cylinder housing 40 also rotates clockwise as indicated by arrow 47.

In a preferred embodiment, as best shown by numbers noted in FIG. 3, three gripping assemblies 80, 82, and 84 are utilized to grip the pipe within upper rotatable tong 12 and/or lower fixed position tong 14. The gripping assemblies of both upper tong 12 and lower tong 14 may be substantially similar, if desired. Gripping assemblies 80–84 may be substantially similar, and may operate similarly, if desired. Alternatively, one or more of the gripping assemblies may be substantially different and operate differently, if desired. Gripping assemblies 80–84 may be manually operated, hydraulically operated, or pneumatically operated, or some combination thereof. In a preferred embodiment, gripping assembly 82 is utilized as a guide member and may preferably be affixable in a desired selectable position that is determined by the size of pipe to be operated upon by tong system 10. Once fixed in the desired position, bite die 86 of gripping assembly 82 does not move but is affixed in position to thereby act as a guide to position the pipe in the correct position when the pipe is inserted into opening 62. On the other hand, gripping assemblies 80 and 84 move respective bite dies 88 and 90 radially inwardly and outwardly to thereby grip the pipe and/or release the pipe, as required. Rod 100, which may or may not be piston activated, or threadably activated, may be moveable for moving bite die 86 to the desired position. Adjustment member 102 may be utilized to select and affix piston rod 100 in the desired position either manually or automatically. Adjustment member 102 may have latches, thread connections, or the like to thereby affix and securely hold bite die 86 in the desired selected position.

In one embodiment, bite dies 88 and 90, may be moved radially inwardly for gripping each joint of pipe, and then be moved radially outwardly for releasing the pipe. Bite dies 88 and 90 may preferably be moved automatically, such as by actuators 92 and 94. Actuators 92 and 94 may preferably be piston activated for moving respective piston rods 96 and 98 inwardly and outwardly as needed, and may be pneumatic, hydraulic, electric, or as desired. Once bite dies 88 and 90 engage the pipe, then the connection can be rotated with high torque.

Various sensors, such as sensors 104, 105, 106, 112, 114, 119 maybe utilized to monitor operation information of interest. For instance, sensors 104, 105, and 106 may be utilized to measure the amount of gripping pressure applied to the pipe by bite dies 86–90. If desired, a control may be provided to limit this gripping pressure to prevent too much pressure as may occur with certain types of pipe. As well, the pressure may be varied depending on the amount to which the threaded connection is made up. For instance, the pressure may be limited during spinning when the threaded box connection is not internally supported by the threaded pin connection. A control may be provided to vary the pressure between spinning and torquing operations or even during the process of spinning and/or torquing, if desired. The amount of torque applied may be measured by sensor 112 and/or sensor 114. The position of member 30 may be monitored by sensor 114 so that, if desired, torque versus degrees of rotation may be measured, plotted, and/or recorded as desired.

Referring to FIG. 5, various means maybe provided to move system 10 into position for operation such as a moveable member, boom, cables, wheels, rails and the like for which base 116 may be adapted. System 10 may be moved into position for each joint, or may simply remain in a single position while building in or removing the pipe string. Mounts 118 may be used to lift system 10 upwardly or downwardly as required to position upper tong 12 and lower tong 14 in the desired vertical position with respect to the pipe. The mounts maybe hydraulically or pneumatically moveable, such as with pistons, as desired. Mounts 38, which may also be hydraulically or pneumatically moveable, may also be expandable/contractible to control the spacing between upper tong 12 and lower tong 14.

Slips 117 may be utilized to grip pipe 18 to support the pipe string, as desired. Slips 117 may be automatic slips, if desired. In one embodiment, slips 117 may comprise sender/receiver sensor/actuator 119 for sending receiving commands and status information about the slips, e.g., slips open or slips closed. Thus item 119 may comprise one or more or all components operable to provide an electronic sender, or electronic receiver, or electronic sensor, or an actuator. Sender/receiver/sensor/actuator 119 may be wireless or cable connected. Various types of sensors maybe utilized. For instance, pipe inspection device 120 and/or 122 maybe utilized to magnetically and/or electromagnetically inspect the pipe for defects when running the pipe into the wellbore or removing it therefrom. If desired, the pipe inspection results may also be utilized to detect the position of joint 20 and/or the tops or bottom of pipe 16 and 18. Once the position is known, then the system may automatically adjust its position to the pipe. Thus, pipe inspection device may comprise an electric coil, acoustic signal sender, magnetic flux detector, or other means for detecting discontinuities. The same components may also be used for detecting joint components such as the pin or box end of the joint as well as joints that are made up. The pipe inspection device and/or collar locator are mounted in a clearance position with respect to the pipe and do not require contact with the pipe to operate. If desired, the collar locator, if used, may be a separate component and spaced apart from the pipe inspection device. Moreover, more than one pipe inspection device or collar locator could be used for more complete inspection and/or faster location of collars to thereby more quickly move upper tong 12 and lower tong 14 into position.

In another embodiment, suitably located cameras, such as cameras 124, 126, and/or 128, maybe utilized, along with suitable lighting, to provide the driller or system 10 operator, a clear view of the position of the pipe joint. Thus, in FIG. 6, the position of the pipe and/or the position of system 10 and/or upper tong 12 and/or lower tong 14 may be seen in monitor 132 and compared with reference lines 130 for exact positioning. The optical system may be manually operated by the drill utilizing monitor 132 and/or other displays and controlling the equipment, such as system 10 height controls and/or the pipe handling equipment such as the blocks, slips, and the like.

Figure 6:
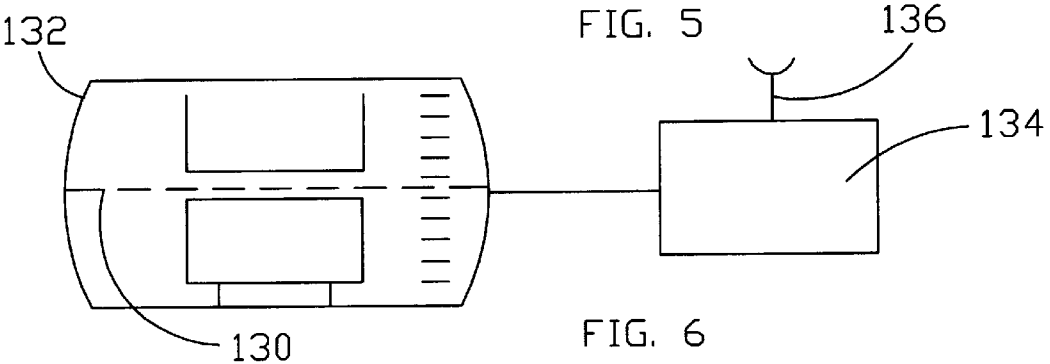
FIG. 6 is a monitor that may be utilized by a driller for highly accurate placement of the tongs with respect to the pipe.

Alternatively, the shapes of pipe connections are easily recognizable with an optical recognition system, for example in FIG. 6, that may be controlled by controller or computer 134. Optical recognition may be faster and, for example in FIG. 6, more reliable for locating the relative position of upper tong 12 and lower tong 14 with respect to a particular part of the joint which can be quickly recognized, e.g., the top outline of the socket or bottom outline of the pin, or when the pipes are connected then the profile of the connected joint. Thus, the optical system may comprise an optical collar locator that may be used to adjust the relative heights of upper tong 12 and lower tong 14. Moreover, the system may be used for inspecting the wellbore tubulars when the wellbore tubulars are clean and dry, as maybe provided when the tubulars are run into the hole by washing the pipe and allowing the pipe to dry.

If desired, automatic positioning means such as magnetic or coil produced collar signals, which may also be produced by the casing inspection coils, may be used in conjunction, such as for rough location, and automatic or manual visual means, such as monitor 132, may be used in conjunction for positioning upper tong 12 and lower tong 14 correctly.

Antenna 136 maybe used to receive signals wirelessly from the various sensors discussed above and/or the cameras. Moreover, antenna 136 and control 134 may be electronically interconnected to tong system 10 to operate tongs 12 and 14, raise and lower tongs 12 and 14, move system 10 as necessary, and for other desired automatic controls. Moreover, automatic control 134 may be utilized for operating slips 117 and may be utilized to send/receive status information and commands wirelessly or through cables to sender/receiver 119.

Thus, in any one of the manners discussed herein or in any combination thereof, enhanced tong operation is achieved. It may be seen from the preceding description that a new and improved powered tong system 10 has been provided. Although very specific combination examples have been described and disclosed, the invention of the instant application is considered to comprise and is intended to comprise any equivalent structure.

The foregoing disclosure and description of the invention is therefore illustrative and explanatory of one or more presently preferred embodiments of the invention and variations thereof, and it will be appreciated by those skilled in the art that various changes in the design, organization, order of operation, means of operation, equipment structures and location, methodology, and use of mechanical equivalents, as well as in the details of the illustrated construction or combinations of features of the various elements, may be made without departing from the spirit of the invention. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. As well, the relative size and arrangement of the components may be greatly different from that shown and still operate well within the spirit of the invention as described hereinbefore and in the appended claims. It will be seen that various changes and alternatives maybe used that are contained within the spirit of the invention. Moreover, it will be understood that various directions such as "upper," "lower," "bottom," "top," "left," "right," "inwardly," "outwardly," and so forth are made only with respect to easier explanation in conjunction with the drawings and that the components may be oriented differently, for instance, during transportation and manufacturing as well as operation. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

It is claimed:

1. A power tong system operable for making and breaking joints between wellbore tubulars, said power tong system comprising:

a frame;

a spinner secured to said frame, said spinner being operable for spinning said wellbore tubulars for said making and breaking of said joints;

a first member pivotally connected with respect to said frame such that said first member is rotatable with respect to said frame, said first member defining an aperture therein for receiving said wellbore tubulars;

a first plurality of gripping members mounted to said first member for gripping and releasing said wellbore tubulars;

an assembly comprising a piston slidable within a cylinder, said assembly being pivotally mounted with respect to said frame, said assembly being pivotally mouhted with respect to said first member such that said first member is rotatable with respect to said frame in response to movement of said piston with respect to said cylinder;

a second member mounted to said frame, said second member defining an aperture therein for receiving said wellbore tubulars; and a second plurality of gripping members mounted to said second member for gripping and releasing said wellbore tubulars further comprising:

a control arm mounted to said first member, said control arm being moveable between a first position and a second position, when said control arm is in said first position, then said first member is rotatable for tightening said wellbore joints, when said control arm is in said second position, then said first member is rotatable for loosening said wellbore joints.

2. The power tong system of claim 1, further comprising:

a fastener for selectively securing said control arm in said first position or said second position.

3. The power tong system of claim 2, wherein said fastener further comprises a pin.

4. The power tong system of claim 1, further comprising:

a pivotal connection between said control arm and said first member.

5. The power tong system of claim 1, further comprising:

a pivotal connection between said control arm and said assembly.

6. A power tong system operable for making and breaking joints between wellbore tubulars, said power tong system comprising:

a frame;

a first member pivotally connected with respect to said frame such that said first member is rotatable with respect to said frame, said first member defining an aperture therein for receiving said wellbore tubulars;

a first gripping assembly mounted to said first member for gripping and releasing said wellbore tubulars;

an assembly comprising a piston slidable within a cylinder, said assembly being pivotally mounted with respect to said frame;

a control arm mounted to first member, said assembly being pivotally connected to said control arm such that said first member is rotatable with respect to said frame in response to movement of said piston with respect to said cylinder;

a second member mounted to said frame, said second member defining an aperture therein for receiving said wellbore tubulars; and a second gripping assembly mounted to said second member for gripping and releasing said wellbore tubulars.

7. The power tong system of claim 6, further comprising:

a pivotal connection between said control arm and said first member, said control arm being pivotally moveable between a first position and a second position with respect to said first member, when said control arm is in said first position, then said first member is rotatable for tightening said wellbore joints, when said control arm is in said second position, then said first member is rotatable for loosening said wellbore joints.

8. The power tong system of claim 7, further comprising:

a fastener for selectively securing said control arm in said first position or said second position.

9. The power tong system of claim 8, wherein said fastener further comprises a pin.

10. The power tong system of claim 6, wherein said first gripping assembly further comprises a plurality of gripping members mounted to said first member, said plurality of gripping members being movable inwardly and outwardly for gripping and releasing said wellbore tubulars.

11. The power tong system of claim 10, wherein at least one of said plurality gripping members comprises a guide, said guide being moveable to a selectable position for a size of said wellbore tubulars, said guide being affixed in said selectable position during gripping and releasing of said wellbore tubulars, a second of said plurality of gripping being radially moveable inwardly and outwardly for gripping and releasing said wellbore tubulars.

12. The power tong system of claim 11, wherein first member defines a slot therein for lateral insertion of said wellbore tubulars to said aperture, said guide is positioned for receiving said wellbore tubulars on an opposite side from said slot.

13. A power tong system operable for making and breaking joints between wellbore tubulars, said power tong system comprising:

a frame;

a first member pivotally connected with respect to said frame such that said first member is rotatable with respect to said frame, said first member defining an aperture therein for receiving said wellbore tubulars;

a first gripping assembly mounted to said first member for gripping and releasing said wellbore tubulars;

a second member mounted to said frame, said second member defining an aperture therein for receiving said wellbore tubulars;

a second gripping assembly mounted to said second member for gripping and releasing said wellbore tubulars;

a first lift assembly attached to said frame for moving said first member and said second member upwardly and downwardly to align said first member and said second member with respect to said joints;

a joint connection detector operable for detecting joint connector components for producing a joint signal to indicate said joint connection components, said joint connection detector being in a clearance position with respect to said joint connection components; and an automatic control for receiving said joint connector, said automatic control being operable for operating said first lift assembly to automatically align said first gripping assembly and said second gripping assembly with respect to said joints.

14. The system of claim 13, wherein joint connection detector further comprises a pipe inspection apparatus.

15. The system of claim 13, wherein said joint connection detector comprises an optical recognition system.

16. The system of claim 13, further comprising:

automatic slips, a sender for said automatic slips for sending status information said status information being received by said control.

17. The system of claim 13, further comprising:

a plurality of sensors operable for measuring torque versus turn during said making up of said joints.

18. The system of claim 13, further comprising:

an assembly comprising a piston slidable within a cylinder, said assembly being pivotally mounted with respect to said frame.

19. The system of claim 18, further comprising:

a control arm mounted to first member, said assembly being pivotally connected to said control arm such that said first member is rotatable with respect to said frame in response to movement of said piston with respect to said cylinder.

20. The system of claim 13, further comprising:

a second lift assembly attached to said frame for moving said first member away from or closer to said second member.

* * * * *